United States Patent [19]

Brookes

[11] 4,048,676

[45] Sept. 20, 1977

[54] COVERING PIECE FOR A WATER CLOSET ASSEMBLY

[75] Inventor: Cyril James Brookes, Campbelltown, Australia

[73] Assignee: Reed Building Products, Pty. Limited, Elizabeth, Australia

[21] Appl. No.: 730,824

[22] Filed: Oct. 8, 1976

[51] Int. Cl.[2] ..... A47K 17/00

[52] U.S. Cl. ..... 4/1; 4/12

[58] Field of Search ..... 4/1, 12, 134, 13, 14; 150/52 R

[56] References Cited

U.S. PATENT DOCUMENTS

| | | | |
|---|---|---|---|
| 1,359,892 | 11/1920 | Hinsdale | 4/12 |
| 1,771,007 | 7/1930 | Weaver | 4/12 |
| 1,776,386 | 9/1930 | Hohmeister | 4/12 |
| 2,089,775 | 8/1937 | Wexelberg et al. | 4/12 |
| 2,567,607 | 9/1951 | Larson | 4/12 |
| 3,524,203 | 8/1970 | Ruggles | 4/1 |
| 3,716,872 | 2/1973 | Zieman | 4/12 |

*Primary Examiner*—Henry K. Artis
*Attorney, Agent, or Firm*—Edward C. Threedy

[57] ABSTRACT

The invention provides an aesthetic covering piece or bridging means between a toilet bowl and the associated flush tank to give a unitary appearance, to facilitate cleaning and to improve hygiene, the single bridging means cooperating with alternative tank covers without being supported by the tank or tank cover. The bridging cover-piece slides in adjustable relationship with respect to a supporting bracket which is fixed to the wall below the flush tank and which may support the tank, if desired. The bridging cover-piece can therefore be fitted without cutting to size or alteration. The form of the cooperating supporting bracket depends upon whether the assembly uses a light-weight tank cover or a heavy vitreous china cover. The bridging cover-piece and supporting bracket may be used in conjunction with suitable existing tanks and tank covers.

10 Claims, 7 Drawing Figures

COVERING PIECE FOR A WATER CLOSET ASSEMBLY

SUMMARY OF THE INVENTION

The present invention relates to a toilet flush tank assembly which is associated closely with a toilet bowl so that the spacing between the two is small. Both for aesthetic and cleanliness reasons, it is desirable to achieve a substantially unitary appearance and interconnecting surface between the tank and the bowl so as to hide unsightly flush pipes and to protect them from the deposit of dust and dirt and to present a relatively unbroken surface between the tank and the bowl to facilitate cleaning.

These objects and improvement in the stability, appearance, and the fastening of the assembly, and, where desired, the support of the tank, are achieved by the provision of a basic cover-piece of single form between the bowl and tank assembly, and a support bracket, and, optionally, a tank cover, the bracket being in two forms according to the type of tank cover employed or the strength factor desired.

The basic unifying cover-piece between the bowl and the tank is supported by a bracket in a releasably fastened manner so as to permit adjustments without alteration or cutting, to meet variations in the distance between the toilet bowl and the wall.

The support bracket is securable to the wall beneath the toilet tank and can support the tank as well as the cover-piece, but without being secured to the tank. In this arrangement the tank may also be attached at the upper portion thereof to the wall. The bracket is devised to be clear of the flush pipe and is not secured thereto in any way.

The tank cover is secured at the top to the flush tank by means of a press-button securing ring. Mounting lugs may be provided, if desired, on either side at the bottom of the tank cover when it is made of plastic material, to allow the cover to be secured to the wall.

It will be apparent that other advantages may be obtained, if desired, from the assembly described in this specification. For instance, the tank cover may be replaced by more modern designs as time progresses, without disturbing the general installation. In some circumstances old installations with flush tanks secured to the wall by other means, may be up-dated by fixing brackets below the existing tank and then fitting such other components of the assembly as are desired. The use of such a tank cover also permits the use of less expensive and more easily produced flush tanks.

The basic unifying component of these various modifications of the assembly is the standard cover-piece which is described herein, with features which will provide cooperation, as hereinbefore mentioned, with either a plastic cover or a heavier cover made of vitreous china, metal or other heavy material. It will be apparent that a cover-piece made to cooperate with only a plastic, or only a vitreous china or some other heavy tank cover, can easily be derived from this disclosure, which will be within the teachings and boundaries of this invention. Its shape at the front may also be adjusted to cooperate with different makes or shapes of toilet bowls.

Where the tank cover is made of plastic, sufficient support and strength is available from the use of a bracket made from plastic material, but where the heavier tank cover is used or stronger support is needed, a modified bracket made from stronger material, such as metal, is used to cooperate with the standard cover-piece.

There is also described an arrangement for securing the lower edge of the plastic tank cover in the plastic bracket, if this is desired. However, neither the plastic nor the vitreous china covers need be fixed to the wall or to the cover-piece, and thus easy removal from the bracket is possible, notwithstanding that a stable assembly is achieved.

The invention provides a cover-piece for a toilet tank and bowl assembly to provide a smooth transition between the bowl or bowl seat and the flush tank so as to provide a pleasing appearance and facilitate cleaning and avoiding the deposit of dirt therebetween, the cover-piece being supported by a bracket attached to the wall below the flush tank and being slidably adjustable relative to the bracket before final fixing so that the front edge of the coverpiece may be brought as close to the bowl as possible, the cover-piece and bracket being clamped in a firm but releasable relationship by means of screws. The invention also provides tank covers for cooperation with the toilet tank and bowl assembly to provide these objectives.

GENERAL DESCRIPTION

The invention will now be described with reference to the drawings, wherein.

Figure 3:
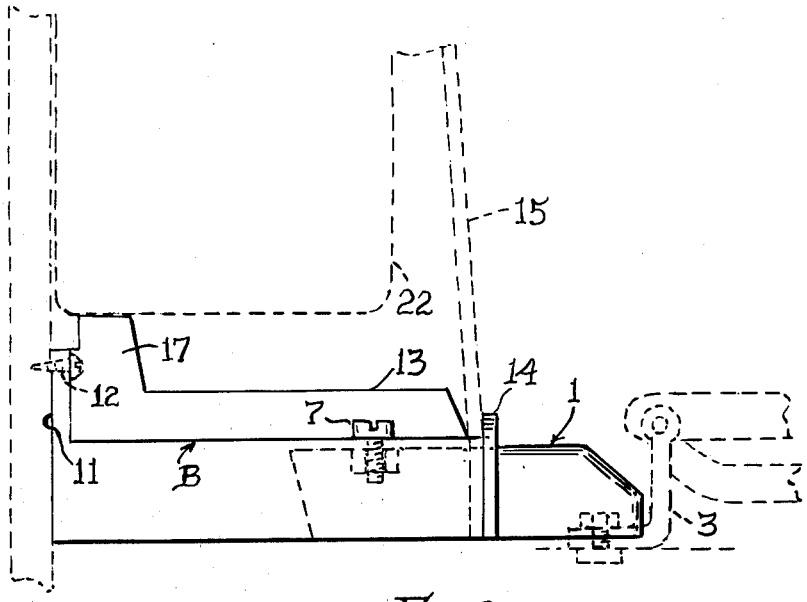
Figure 4:
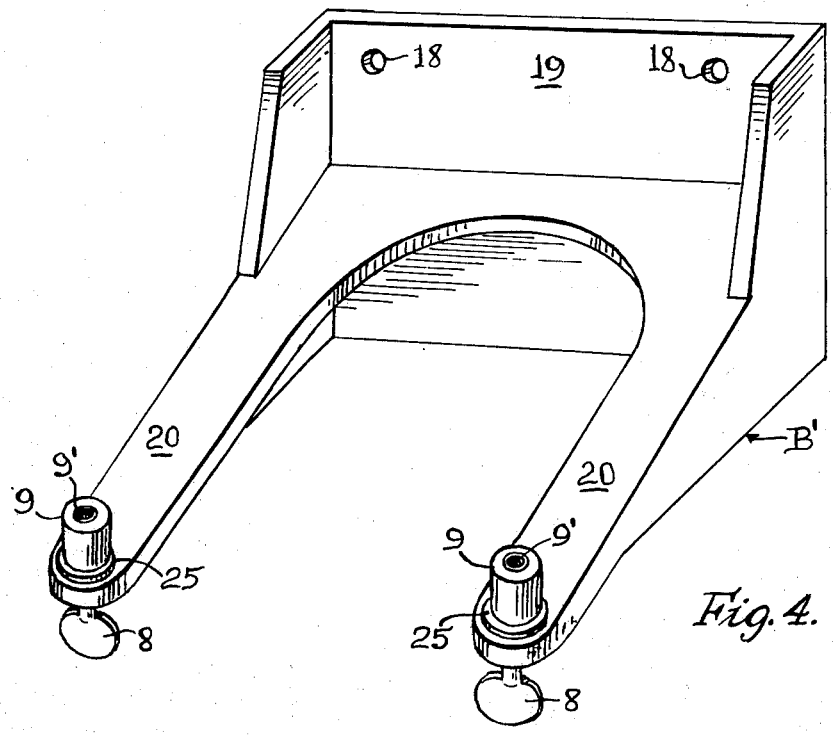
Figure 5:
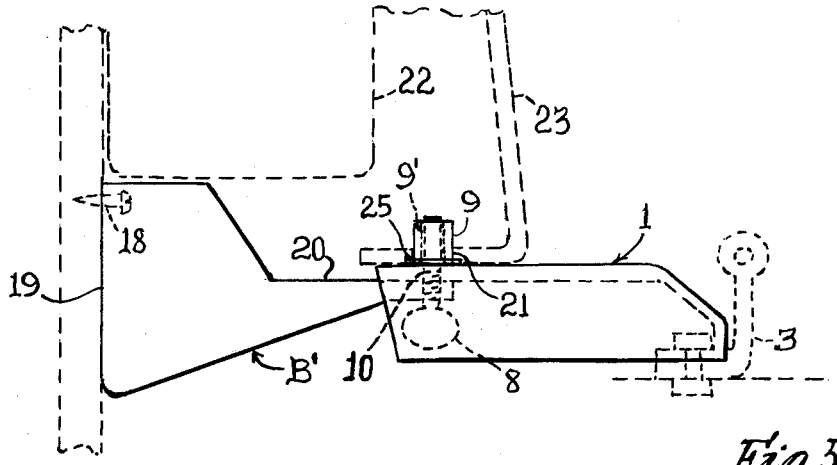
Figure 6:
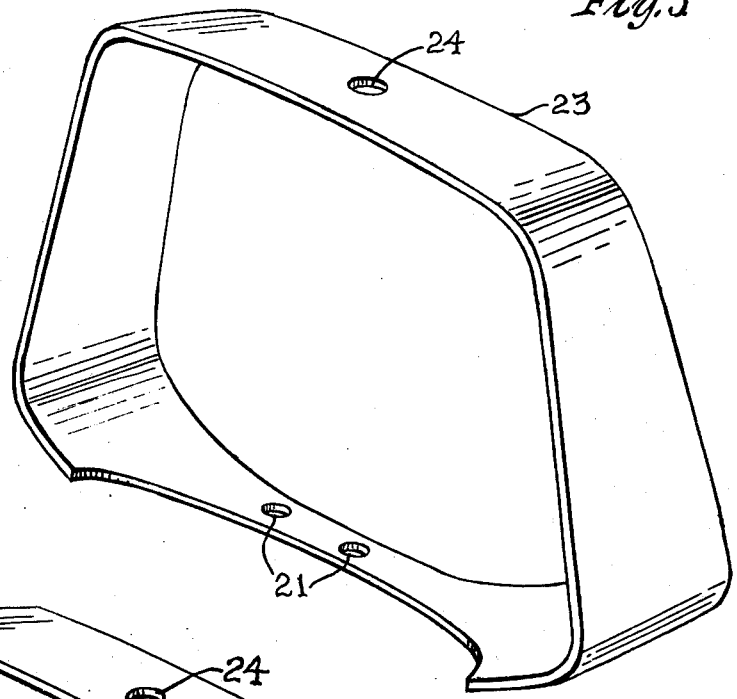
Figure 7:
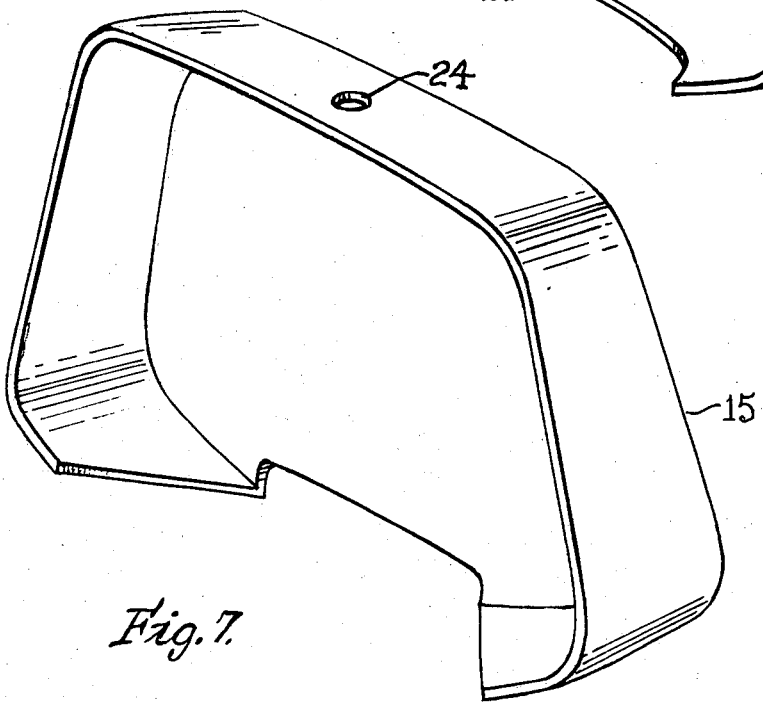

FIG. 3 indicates the cooperation of the standard cover-piece with a support bracket used for a plastic tank cover as employed in a toilet tank and bowl assembly;

FIG. 4 shows the variation adopted in conjunction with a vitreous china or other heavy tank cover, with compressible rubber mounting bushes shown in position;

FIG. 5 shows the cooperation of a standard cover-piece with a support bracket used with a vitreous china tank cover;

FIG. 6 shows the configuration of a cover for covering a flush tank where a vitreous china or heavy cover is employed; and FIG. 7 shows the configuration of a cover for covering a flush tank where a plastic cover is used.

Figure 1:
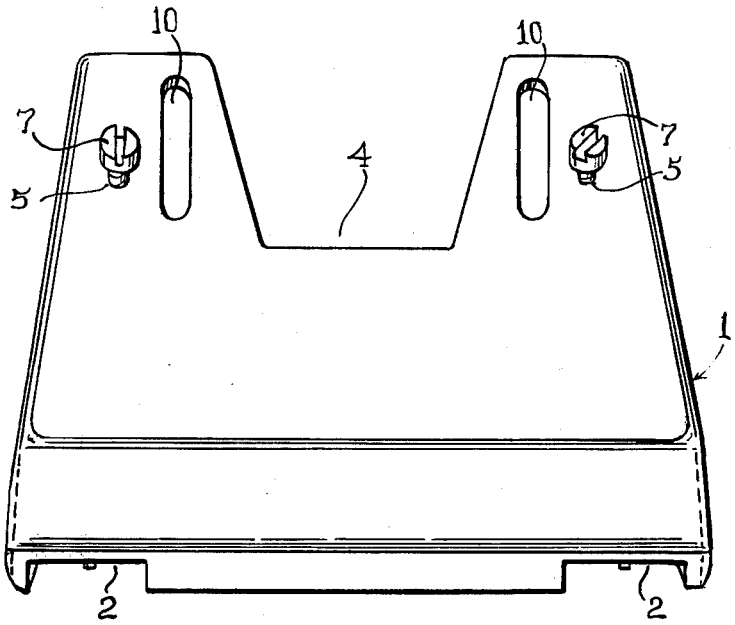
FIG. 1 shows a standard cover-piece which is used to bridge the space between the flush tank or cover and the toilet bowl.

The standard cover-piece 1 shown in FIGS. 1, 3 and 5, has the general form of a three-sided inverted tray, the front side of which has a blunt or rounded nose and the lower edge of which has cut-out portions 2 to fit around the bowl seat support hinges 3. A truncated V-shaped portion 4 or other suitable shape is cut out of the opposite side of the tray to allow the cover-piece 1 to avoid obstruction by the flush pipe from the tank when the cover-piece is in the least extended position. Threaded holes 5 receive screws 7, preferably though not necessarily plastic, which have previously passed through the slots 6 in the plastic support bracket B (FIG. 2) and this clamp the cover-piece 1 to the underside of the support bracket B into which the cover-piece slides before being clamped in the desired position by the screws 7. The slots 6 have sufficient length to allow adequate adjustment. As indicated in FIG. 3, additional thickness of the cover-piece 1 may be provided to allow a sufficient length of threaded hole 5. The upper edges of the cover-piece 1 are rounded to present a pleasing appearance and to eliminate accumulation of dust or soil.

When the cover-piece 1 is used with the vitreous china or heavy tank cover supporting bracket B' shown in FIG. 4, the screws 7 are discarded and the metal screws 8 and compressible threaded bushings 9 are used to clamp the cover-piece to the top side of the support bracket and to hold the cover bottom in position. There is preferably provided on the lower side of each compressible bushing 9 a washer 25, and the threading of the bushing 9, which may be made of rubber or like resilient material, is provided in the most effective fashion by a metal insert 9' in the upper part of the bore of the bushing 9 into which the screw 8 enters. In assembly, the screws 8 are passed up through clearance holes formed near the ends of the arms 20 of the bracket B', then through the slots 10 in the cover-piece 1 which lies on top of the arms 20, through the washers 25, and into the bushings 9 to mate with the thread therein. The slots 10 have sufficient length to provide adequate adjustment, and the clearance holes in the ends of the arms 20 are of sufficient size to allow for sidewise adjustment to meet manufacturing tolerance variations in the position of the tank cover holes into which the compressible bushings 9 enter.

Figure 2:
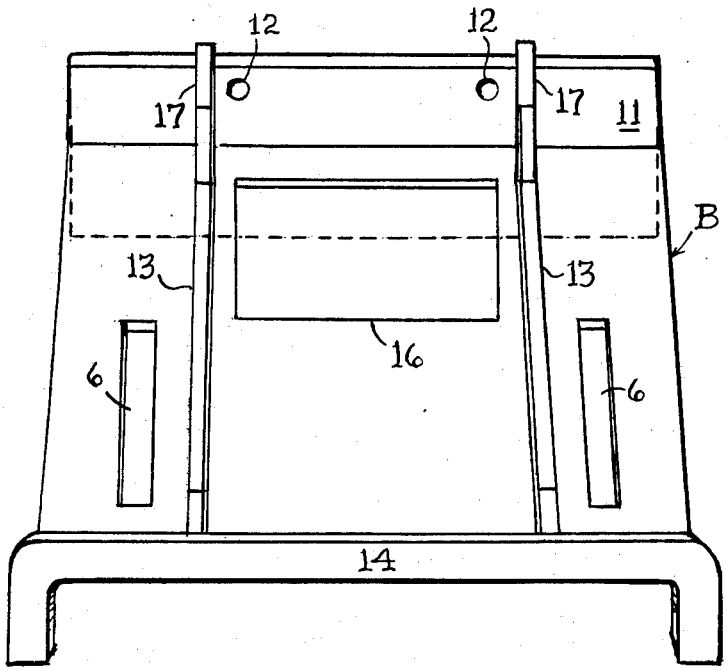
FIG. 2 shows a mounting or support bracket used where the tank cover is made from plastic material.

The mounting bracket B shown in FIG. 2, has a back plate 11 containing two holes 12 through which screws pass to fix the bracket to the wall. The bracket B is strengthened by ribs 13 which run from the back plate 11 towards the front of the bracket B, but which stop short of the vertical projection 14 which runs across the front of the bracket B and down both sides. The gap between the ribs 13 and the projection 14 is sufficient to admit the lower edge of a plastic cover 15 (FIG. 3). This is the reason for the configuration of such cover, shown in FIG. 7 of the drawings. The aperture 16 is provided to allow the passage therethrough of the flush pipe from the bottom of the flush tank 22. The previously mentioned screw slots 6 allow the cover-piece 1 to be slidably adjusted in relation to the bracket B before the screws 7 are finally tightened to provide stable cover between the tank 22 and the bowl and over the bowl seat hinge bolts, etc., as shown in FIG. 3. The cover-piece 1 is advanced forwardly to be as close as possible to the bowl seat and seat lid. The strengthening ribs 13 have a shape as indicated in FIG. 3, the upper stepped portion 17 forming a support for the tank 22, when desired.

The mounting bracket B' shown in FIG. 4, which is used to support the assembly when a vitreous china or other heavy cover is employed (see FIG. 6), or when additional strength is required, has an upstanding back plate 19 and right-angled and forwardly directed extensions to support the tank 22 (FIG. 5) where desired, and contains holes 18 for screwing the support to the wall. The cover-piece 1 is clamped on the top of the arms 20 as earlier explained, with the flush pipe passing between these arms. The compressible bushings 9 are positioned so as to enter the holes 21 (see FIG. 6) to retain the tank cover 23 in position against horizontal movement. The screws 8 can be tightened by hand from below, and if only the upper part of the bore of the bushings 9 is threaded, tightening of the screws 8 cause the bushings 9 to expand in the holes 21 and consequently grip the cover 23 to hold it firmly in position.

FIG. 5 shows the vitreous china cover 23 seated over the bracket support and cover-piece 1 so that the hole 21 registers with the bushing 9. Once again the cover-piece is advanced as closely as possible to the bowl seat and seat lid before finally tightening the screws 8.

The variations of the cover configuration for the plastic and vitreous china versions have been shown in FIGS. 7 and 6, respectively, but, as previously stated, the plastic form may, if desired, have lugs molded at the lower back extremities to permit screw-attachment at the bottom of the tank cover to the wall. In all forms of material, the tank cover 15 or 23 is secured at the top of the flush tank 22 by means of a press-button threaded bushing which is screwed into place after the press-button has been passed through the hole 24. The bottom flange of the vitreous china cover 23 is cut out to fit around the flush pipe from the tank 22 and also any water inlet and overflow points in the bottom of the flush tank 22. The plastic cover 15 has an open back and open bottom so that it can be fitted over the tank 22 from directly thereabove, while the vitreous china cover 23 is fitted from the front of the flush tank 22 due to the presence of the bottom flange provided for support and fixing purposes over the compressible bushings 9.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. A cover-piece between a freestanding toilet bowl and an independent wall-supported flush tank providing a cover therebetween comprising a. a cover plate supporting bracket attached to the wall below the independent wall-supported flush tank, b. a cover plate adapted to be supported by said bracket, c. means for connecting said cover plate to said bracket for slidable adjustment thereover relative to the freestanding toilet bowl, and d. means to clamp said cover plate upon said bracket in a predetermined position between the freestanding toilet bowl and the independent wall-supported flush tank.

2. A cover-piece as defined by claim 1 wherein the cover plate provides a downwardly extending skirt on two edges thereof, a nose on the front, with cut-out portions adapted to fit over corresponding portions of the toilet bowl, and an open back with a truncated V-shaped cut-out so that the adjustment of the cover plate over said bracket will not be restricted by the flush tank pipe.

3. A cover-piece as defined by claim 1 wherein said means for connecting the cover plate to said bracket comprises screw elements adapted to project through elongated slots provided by said bracket and to be received in tapped screw holes formed in said cover plate.

4. A cover-piece as defined by claim 2 wherein said means for connecting the cover plate to said bracket comprises screw elements adapted to project through elongated slots provided by said bracket and to be received in tapped screw holes formed in said cover plate.

5. A cover-piece as defined by claim 1 including a cover for said wall-supported flush tank, with said tank cover adapted to be supported by said cover plate when the latter is connected to said bracket.

6. A cover-piece as defined by claim 3, wherein said supporting bracket has a vertical back plate adapted to be connected to the wall for supporting said bracket thereto and downwardly extending sides and having slots formed in a horizontal surface provided by the bracket, an open-ended front skirted on the top and sides by a vertical projection, and reinforcing ribs extending from the back plate in the direction of the open-ended front and terminating short of said vertical projection, said tank cover having an edge insertable between said ribs and said vertical projection so as to be supported by said bracket, with said ribs being of a predetermined height so as to support said flush tank when said tank cover is positioned thereover and said cover plate is positioned between said toilet bowl and said flush tank.

7. A cover-piece as defined by claim 6 wherein said tank cover is provided with a cut-out on its lower front edge to permit the tank cover to be retained behind the front vertical projection provided by said bracket.

8. A cover-piece as defined by claim 6 wherein said tank cover is provided with lugs adjacent to the bottom portion thereof for securing said tank cover to the wall.

9. A cover-piece as defined by claim 7 wherein said tank cover is provided with lugs adjacent to the bottom portion thereof for securing said tank cover to the wall.

10. A cover-piece as defined by claim 5 wherein said tank cover provides an inwardly turned bottom flange, with said flange having holes formed therein to register with the means for connecting the cover plate to said bracket to support said tank cover in a covering position over said flush tank when the cover plate is positioned between said toilet bowl and said flush tank.

* * * * *